US010957980B2

(12) United States Patent
Liu et al.

(10) Patent No.: US 10,957,980 B2
(45) Date of Patent: Mar. 23, 2021

(54) ANTENNA SYSTEM AND TERMINAL

(71) Applicant: Beijing Xiaomi Mobile Software Co., Ltd., Beijing (CN)

(72) Inventors: Jiarong Liu, Beijing (CN); Han Lu, Beijing (CN)

(73) Assignee: Beijing Xiaomi Mobile Software Co., Ltd., Beijing (CN)

( * ) Notice: Subject to any disclaimer, the term of this patent is extended or adjusted under 35 U.S.C. 154(b) by 0 days.

(21) Appl. No.: 16/377,529

(22) Filed: Apr. 8, 2019

(65) Prior Publication Data

US 2020/0076080 A1 Mar. 5, 2020

(30) Foreign Application Priority Data

Aug. 31, 2018 (CN) ..... 201811014066.0

(51) Int. Cl.

| | |
|---|---|
| ***H01Q 5/50*** | (2015.01) |
| ***H01Q 1/24*** | (2006.01) |
| ***H01Q 1/52*** | (2006.01) |
| ***H01Q 1/44*** | (2006.01) |
| ***H01Q 5/335*** | (2015.01) |
| ***H01Q 5/314*** | (2015.01) |

(52) U.S. Cl.

CPC ..... *H01Q 5/50* (2015.01); *H01Q 1/243* (2013.01); *H01Q 1/44* (2013.01); *H01Q 1/521* (2013.01); *H01Q 5/314* (2015.01); *H01Q 5/335* (2015.01)

(58) Field of Classification Search

CPC ..... H01Q 5/50

See application file for complete search history.

(56) References Cited

U.S. PATENT DOCUMENTS 4,291,312 A 9/1981 Kaloi
8,587,481 B2 * 11/2013 Lai ..... H01Q 1/243 343/700 MS (Continued)

FOREIGN PATENT DOCUMENTS

AU 2003228322 A1 9/2003
CN 204348912 U 5/2015

(Continued)

OTHER PUBLICATIONS

Chinese Office Action issued by the State Intellectual Property Office (SIPO) of the People's Republic of China dated Jan. 20, 2020, in counterpart Chinese Application No. 201811014066.0.

(Continued)

*Primary Examiner* — Ab Salam Alkassim, Jr.
(74) *Attorney, Agent, or Firm* — Finnegan, Henderson, Farabow, Garrett & Dunner, L.L.P.

(57) ABSTRACT

An antenna system is provided. The antenna system includes a first metal radiator, a second metal radiator, a first matching network, a second matching network, a first radio frequency path, and a second radio frequency path, wherein a tail end of the first metal radiator is connected with a first feed point of the antenna system and the first feed point is connected with the first radio frequency path through the first matching network; and a tail end of the second metal radiator is connected with a second feed point of the antenna system and the second feed point is connected with the second radio frequency path through the second matching network. A terminal including the antenna system is also provided.

8 Claims, 11 Drawing Sheets

(56) References Cited

U.S. PATENT DOCUMENTS

| | | | | |
|---|---|---|---|---|
| 9,337,539 | B1 | 5/2016 | Ananthanarayanan et al. | |
| 10,396,837 | B2 * | 8/2019 | Shin | H01Q 9/42 |
| 10,439,267 | B2 * | 10/2019 | Seo | H01Q 5/40 |
| 10,707,559 | B2 * | 7/2020 | Son | H01Q 5/328 |
| 10,763,573 | B2 * | 9/2020 | Liao | H01Q 1/38 |
| 2003/0214443 | A1 | 11/2003 | Bauregger et al. | |
| 2004/0227683 | A1 * | 11/2004 | Caimi | H01Q 9/42 343/742 |
| 2012/0299785 | A1 | 11/2012 | Bevelacqua | |
| 2016/0064820 | A1 * | 3/2016 | Kim | H01Q 9/04 343/767 |
| 2016/0365623 | A1 * | 12/2016 | Kim | H01Q 1/243 |
| 2017/0033812 | A1 * | 2/2017 | Son | H01Q 21/28 |
| 2017/0048363 | A1 * | 2/2017 | Lee | H04B 1/3833 |
| 2017/0170562 | A1 * | 6/2017 | Lee | H01Q 7/00 |
| 2017/0244151 | A1 * | 8/2017 | Han | H01Q 5/30 |
| 2017/0302771 | A1 * | 10/2017 | Kim | H04M 1/0266 |
| 2017/0346159 | A1 | 11/2017 | Xue et al. | |
| 2017/0365914 | A1 * | 12/2017 | Hong | H01Q 3/24 |
| 2018/0026338 | A1 * | 1/2018 | Lin | H01Q 5/35 343/702 |
| 2018/0026344 | A1 * | 1/2018 | Lee | H01Q 1/2291 343/702 |
| 2018/0026346 | A1 * | 1/2018 | Lee | H01Q 9/42 455/575.7 |
| 2018/0034148 | A1 * | 2/2018 | Nam | H01Q 1/523 |
| 2018/0048051 | A1 | 2/2018 | Chang et al. | |
| 2018/0083343 | A1 * | 3/2018 | Choon | H04M 1/0202 |
| 2018/0115069 | A1 * | 4/2018 | Mai | H01Q 5/30 |
| 2018/0241857 | A1 | 8/2018 | Wang et al. | |
| 2018/0248250 | A1 * | 8/2018 | Hsu | H01Q 5/378 |
| 2018/0248264 | A1 * | 8/2018 | Chen | H01Q 9/40 |
| 2018/0261907 | A1 * | 9/2018 | Ha | H01Q 9/04 |
| 2018/0261921 | A1 * | 9/2018 | Ha | H04M 1/0277 |
| 2018/0277929 | A1 * | 9/2018 | Seo | H01Q 1/241 |
| 2018/0323496 | A1 * | 11/2018 | Lee | H04M 1/026 |
| 2018/0358699 | A1 * | 12/2018 | Li | H01Q 11/14 |
| 2018/0375193 | A1 * | 12/2018 | Zhang | H01Q 9/42 |
| 2018/0375209 | A1 | 12/2018 | Su et al. | |
| 2019/0027830 | A1 * | 1/2019 | Wang | H01Q 5/328 |
| 2019/0036210 | A1 * | 1/2019 | Kim | H01Q 5/35 |
| 2019/0044218 | A1 * | 2/2019 | Ye | H01Q 5/385 |
| 2019/0074575 | A1 * | 3/2019 | Wang | H01Q 1/243 |
| 2019/0131694 | A1 * | 5/2019 | Lee | H01Q 1/243 |
| 2019/0181554 | A1 * | 6/2019 | Lee | H01Q 9/30 |
| 2019/0181555 | A1 * | 6/2019 | Lee | H01Q 1/243 |
| 2019/0207310 | A1 * | 7/2019 | Gu | H01Q 5/335 |
| 2019/0252764 | A1 * | 8/2019 | Liao | H01Q 5/378 |
| 2019/0260405 | A1 | 8/2019 | Son et al. | |
| 2019/0312333 | A1 * | 10/2019 | Kim | H04M 1/0202 |
| 2019/0348750 | A1 * | 11/2019 | Lin | H01Q 1/243 |
| 2019/0372223 | A1 * | 12/2019 | Hsu | H01Q 1/48 |
| 2019/0393586 | A1 | 12/2019 | Ayala Vazquez et al. | |
| 2020/0007184 | A1 * | 1/2020 | Jung | H01Q 1/243 |
| 2020/0052401 | A1 * | 2/2020 | Chang | H01Q 5/35 |
| 2020/0058993 | A1 * | 2/2020 | Qiu | H01Q 5/35 |
| 2020/0076060 | A1 * | 3/2020 | Lin | H01Q 5/35 |

FOREIGN PATENT DOCUMENTS

| | | | | |
|---|---|---|---|---|
| CN | 105655685 | A | | 6/2016 |
| CN | 105655706 | A | | 6/2016 |
| CN | 107069212 | A | * | 8/2017 |
| CN | 107069212 | A | | 8/2017 |
| CN | 107196043 | A | | 9/2017 |
| CN | 107210528 | A | | 9/2017 |
| CN | 107317113 | A | | 11/2017 |
| CN | 108281764 | A | | 7/2018 |
| CN | 108321497 | A | | 7/2018 |
| CN | 108336483 | A | | 7/2018 |
| CN | 110649391 | A | | 1/2020 |
| EP | 3333977 | A1 | | 6/2018 |
| EP | 3367498 | A1 | | 8/2018 |
| JP | 2012-249281 | A | | 12/2012 |
| JP | 2019-100986 | A | | 6/2019 |
| JP | 2020-005252 | A | | 1/2020 |
| TW | 201251202 | A | | 12/2012 |
| WO | 03/079488 | A2 | | 9/2003 |
| WO | WO 2012/166268 | A1 | | 12/2012 |
| WO | 2016127344 | A1 | | 8/2016 |
| WO | WO 2016076605 | A9 | | 10/2016 |
| WO | WO 2017/157346 | A | | 9/2017 |
| WO | WO 2017206367 | A1 | | 12/2017 |

OTHER PUBLICATIONS

International Search Report issued by the State Intellectual Property Office (SIPO) of the People's Republic of China dated May 29, 2019, in counterpart International Application No. PCT/CN2018/114498.

Extended European Search Report issued by the European Patent Office on Jan. 20, 2020, in counterpart European Application No. 19192550.Feb. 1205.

Japanese Office Action dated Nov. 30, 2020, in counterpart Japanese Application No. 2019-549468.

Second Office Action of Japanese Application No. 2019-549468, dated Feb. 1, 2021.

* cited by examiner

ANTENNA SYSTEM AND TERMINAL

CROSS-REFERENCE TO RELATED APPLICATIONS

This application is based upon and claims priority to Chinese Patent Application No. 201811014066.0, filed on Aug. 31, 2018, the disclosure of which is hereby incorporated by reference in its entirety.

TECHNICAL FIELD

The present disclosure relates to the technical field of communications, and particularly, to an antenna system and a terminal including the antenna system.

BACKGROUND

In the related art, for realizing more functions, antennas capable of transmitting radio frequency signals of more frequency bands are required to be added to a terminal. For example, for improving positioning accuracy of satellite navigation, 1176.45 MHz is added as a third frequency for transmitting civil signals at present, and then an antenna capable of transmitting radio signals at this frequency band is required to be added to the terminal. However, how to add an antenna to a terminal installed with antennas without influencing the original antennas in the terminal is an urgent problem to be solved at present.

SUMMARY

In a first aspect, an antenna system is provided. The antenna system includes a first metal radiator, a second metal radiator, a first matching network, a second matching network, a first radio frequency path, and a second radio frequency path, wherein a tail end of the first metal radiator is connected with a first feed point of the antenna system and the first feed point is connected with the first radio frequency path through the first matching network; and a tail end of the second metal radiator is connected with a second feed point of the antenna system and the second feed point is connected with the second radio frequency path through the second matching network.

In a second aspect, a terminal is provided. The terminal includes the antenna system in the first aspect.

It is to be understood that the above general descriptions and below detailed descriptions are only exemplary and explanatory and not intended to limit the present disclosure.

BRIEF DESCRIPTION OF THE DRAWINGS

The accompanying drawings referred to in the specification are a part of this specification, and provide illustrative embodiments consistent with the disclosure and, together with the detailed description, serve to illustrate some embodiments of the disclosure.

DETAILED DESCRIPTION

Reference will now be made in detail to some embodiments, examples of which are illustrated in the accompanying drawings. The following description refers to the accompanying drawings in which the same numbers in different drawings represent the same or similar elements unless otherwise represented. The implementations set forth in the following description of some embodiments do not represent all implementations consistent with the present disclosure. Instead, they are merely examples of apparatuses and methods consistent with aspects related to the present disclosure.

Figure 1:
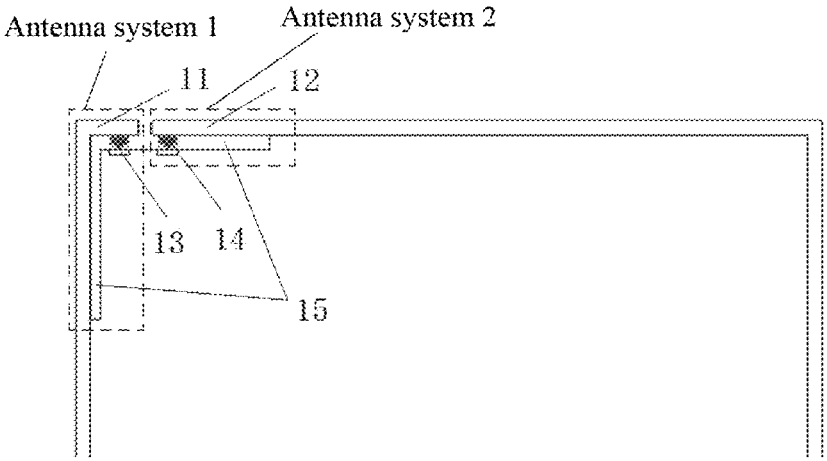
FIG. 1 is a schematic diagram illustrating an antenna system according to some embodiments.

FIG. 1 is a schematic diagram illustrating an antenna system according to some embodiments. The antenna system includes: a first metal radiator 11, a second metal radiator 12, a first matching network (illustrated in FIG. 2), a second matching network (illustrated in FIG. 3), a first radio frequency path (illustrated in FIG. 2), and a second radio frequency path (illustrated in FIG. 3).

A tail end of the first metal radiator 11 is connected with a first feed point 13 of the antenna system, and the first feed point 13 is connected with the first radio frequency path through the first matching network.

A tail end of the second metal radiator 12 is connected with a second feed point 14 of the antenna system, and the second feed point 14 is connected with the second radio frequency path through the second matching network.

In an embodiment, the antenna system may be arranged in a terminal. For fully utilizing a high radiation capability of a metal frame of the terminal, part of the metal frame of the terminal may be used as the first metal radiator and the second metal radiator.

The antenna system may include two antenna systems, i.e., an antenna system 1 and an antenna system 2. For example, the antenna system 1 may include the first metal radiator 11 and a main ground of the antenna system, and a front end (the end opposite to the tail end) of the first radiator 11 is connected with the main ground of the antenna system 1. The antenna system 2 may include the second metal radiator 12 and the main ground of the antenna system, and a front end (the end opposite to the tail end) of the second radiator 12 is connected with the main ground of the antenna system 2. For example, the main ground of the antenna system may include part of a metal rear casing of the terminal, a metal middle frame of the terminal and the like, and the antenna system 1 and the antenna system 2 may share the same main ground.

As shown in FIG. 1, a region 15 is a nonmetal gap or breakpoint in the antenna system. The gap or breakpoint may be, for example, 1.5 mm. The first radio frequency path and the second radio frequency path may be links for radio frequency signal processing and signal transmission. Each link may include multiple electronic components and, for example, may include at least one of a low-noise amplifier, an option switch, a power amplifier, a radio frequency transceiver and the like.

In an embodiment, the first matching network and the second matching network may be LC circuits of different structures, so that the antenna system 1 and the antenna system 2 may cover different frequency bands respectively.

According to the antenna system of the embodiment of the present disclosure, the first metal radiator and the second metal radiator are connected with the first radio frequency path and the second radio frequency path respectively through a respective matching network to form the two antenna systems, radio frequency signals of the two antenna systems may be effectively mutually isolated, so that influence therebetween is avoided and radiation efficiency of the antenna system is improved.

In an embodiment, as shown in FIG. 1, the antenna system may be applied to a terminal. For example, the first metal radiator 11 may be a first metal frame of the terminal and the second metal radiator 12 may be a second metal frame of the terminal. The tail end of the first metal frame is adjacent to the tail end of the second metal frame and a gap is formed between the tail end of the first metal frame and the tail end of the second metal frame. Since the first feed point 13 is connected with the tail end of the first metal radiator 11, the second feed point 14 is connected with the tail end of the second metal radiator 12 and, in the embodiment, the first feed point 13 is relatively close to the second feed point 14, isolation between the antenna system 1 to which the first feed point belongs and the antenna system 2 to which the second feed point belongs may be improved to reduce the influence therebetween.

In an embodiment, a width of the gap between the first metal frame and the second metal frame may be 0.5 mm to 3 mm. The wider the gap, the better the isolation between the two antenna systems is. However, if the gap is wider, the terminal is also correspondingly larger. Therefore, the width of the gap may be set according to a practical requirement.

In an embodiment, the first metal frame corresponding to the first metal radiator 11 may include a transverse extension part (for example, a part extending along a short side of the terminal) and a longitudinal extension part (for example, a part extending along a long side of the terminal). The transverse extension part and the longitudinal extension part make a corresponding frequency point of a GPS L5 waveband and a corresponding frequency point of a 5G frequency band of WiFi fall within an inductive region of a Smith chart and make a corresponding frequency point of a 2.4G frequency band of WiFi fall within a capacitive region of the Smith chart. In such case, inductance and capacitance of the first matching network may be adjusted to implement corresponding resonance of the three frequency bands. In consideration of a difference between the metal frame and the gap filled with a nonmetal material during a practical terminal design, according to an antenna wavelength principle, a total length of the transverse extension part and the longitudinal extension part may be 10 to 30 mm. Under the condition that the feed point 13 of the antenna system 1 is relatively close to the feed point 14 of the antenna system 2, the isolation between the two antenna systems may be relatively poor. This condition may be avoided by combining reasonable reduction in a length of the second metal frame in the antenna system 2 and an effect of an equivalent low-pass filter of the second matching network. Under a normal condition, if it is required to have a resonance frequency at a 1.2 GHz frequency band, an effective length of the metal radiator is a quarter wavelength, about 60 mm. In the embodiment, the length of the second metal radiator may be set to be smaller than 30 mm, and then a frequency point of 1.2 GHz may fall within a first quadrant on the Smith chart (a calculation chart plotted with a normalized input impedance (or admittance) equivalent circle family on a reflection coefficient plane). Similarly, the antenna system 2 may be matched with a region nearby 50 ohms on the Smith chart through the second matching network.

In an embodiment, considering that a practical frequency band of the frequency band corresponding to the GPS L5 waveband is narrow-band, the length of the second metal frame may correspondingly be set to be shorter. For example, the length of the second metal frame may be set to be 12 mm.

In another embodiment, in consideration of a bandwidth of the antenna system and performance such as antenna transmission efficiency, the length of the second metal frame may be properly increased on the basis of 12 mm. For example, the length of the second metal frame is set to be 30 mm.

In an embodiment, the first metal radiator 11 may be arranged to have a resonance frequency at a frequency band corresponding to a GPS L1 waveband, a resonance frequency at a 2.4 GHz frequency band of WiFi and a resonance frequency at a 5 GHz frequency band of WiFi. Correspondingly, the first radio frequency path may be a radio frequency path integrating the frequency band corresponding to the GPS L1 waveband and the 2.4 frequency band and 5 GHz frequency band of WiFi and may be arranged to process and transmit radio frequency signals at these frequency bands.

In an embodiment, the second metal radiator 12 may be arranged to have a resonance frequency at the frequency band corresponding to the GPS L5 waveband. Correspondingly, the second radio frequency path may be a radio frequency path at the frequency band corresponding to the GPS L5 and may be arranged to process and transmit radio frequency signals at the frequency band. In the embodiment, the high radiation capability of the metal frame is fully utilized, one radio frequency path is independently adopted to transmit the radio frequency signals at the newly added GPS L5 frequency band and the second matching network connected with the radio frequency path may have a matching function and may also serve as a low-pass filter to isolate a radio frequency signal of an original three-in-one antenna to greatly improve the isolation between the two antenna systems. Therefore, while ensuring performance of an original three-frequency-band antenna system, the radiation efficiency of GPS L5 is improved and the isolation between different antenna systems is also ensured.

Figure 2:
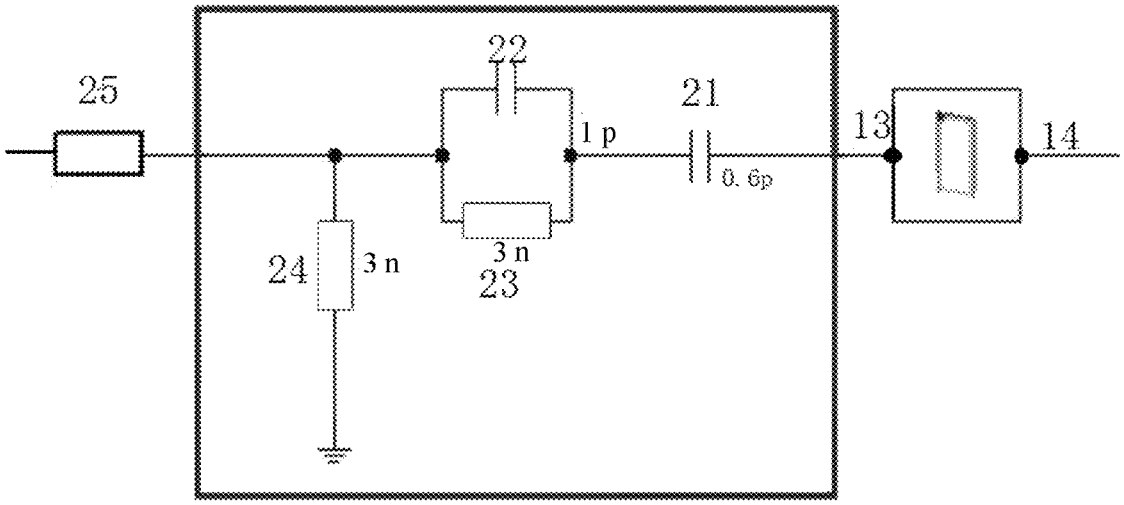
FIG. 2 is a schematic diagram illustrating a first matching network according to some embodiments.

FIG. 2 is a schematic diagram illustrating a first matching network according to some embodiments. As shown in FIG. 2, the first matching network may include: a first capacitor 21, a second capacitor 22, a first inductor 23 and a second inductor 24.

A first end of the first capacitor 21 is connected with the first feed point 13, and a second end of the first capacitor 21 is connected with a first end of the second capacitor 22 and a first end of the first inductor 23.

A second end of the first inductor 23 is connected with a second end of the second capacitor 22, a first end of the second inductor 24 and a first radio frequency path 25, and a second end of the second inductor 24 is grounded. The first matching network may match the frequency band corresponding to the GPS L1 waveband, 2.4 GHz of WiFi and 5 GHz of WiFi of the antenna system 1 to nearby a 50-ohm region in the Smith chart to excite the resonance frequencies at the three frequency bands.

Figure 3:
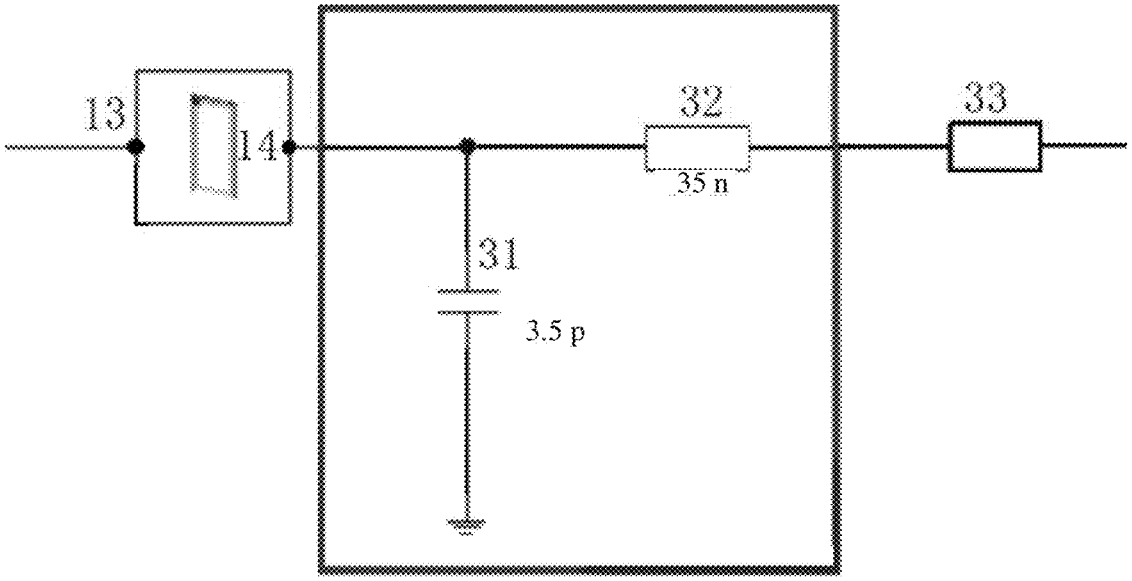
FIG. 3 is a schematic diagram illustrating a second matching network according to some embodiments.
Figure 4:
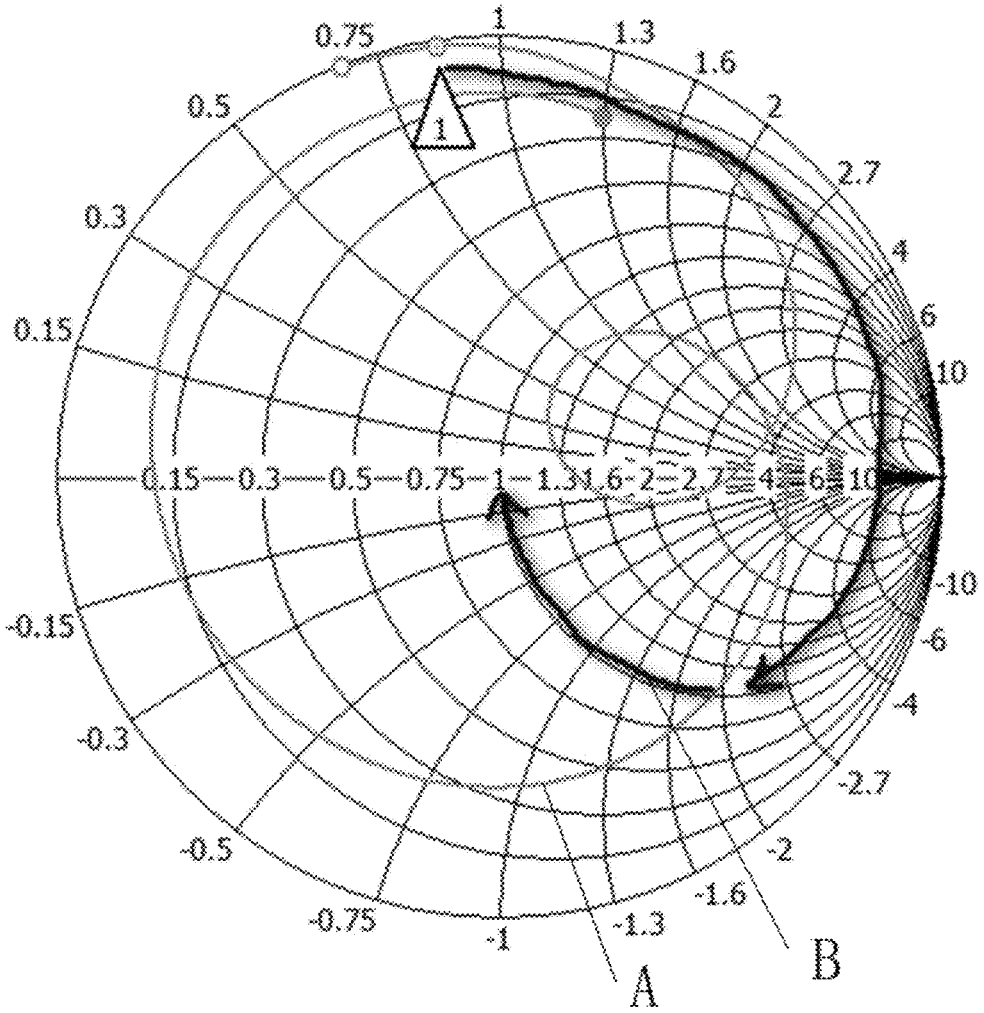
FIG. 4 is a schematic diagram illustrating a trajectory of an antenna system on a Smith chart according to some embodiments.
Figure 5:
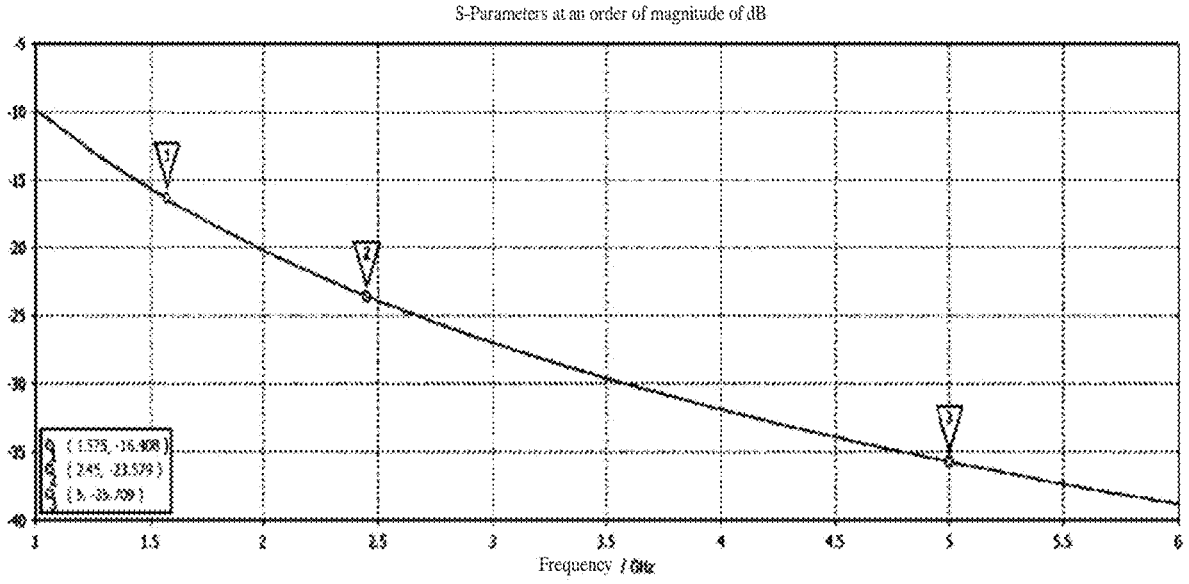
FIG. 5 is a schematic diagram illustrating a directional transmission coefficient of a second matching network according to some embodiments.

FIG. 3 is a schematic diagram illustrating a second matching network according to some embodiments. As shown in FIG. 3, the second matching network may include a third capacitor 31 and a third inductor 32. A first end of the third capacitor 31 is connected with the second feed point 14 and a first end of the third inductor 32, and a second end of the third capacitor 31 is grounded. A second end of the third inductor 32 is connected with a second radio frequency path 33. The second matching network may match the frequency band corresponding to the GPS L5 waveband to nearby the 50-ohm region in the Smith chart to excite the resonance frequency at the frequency band. As shown in FIG. 4, a curve A is a trajectory of the antenna system 1 without any matching network on the Smith chart, a point mark1 being a center frequency of the GPS L5 waveband, and a curve B is a matching function of the second matching network on the point mark1. The second matching network may also serve as a low-pass filter. FIG. 5 is a schematic diagram illustrating a directional transmission coefficient of a second matching network according to some embodiments. As shown in FIG. 5, there exists insertion loss of over 16 dB at a center frequency point of the frequency band corresponding to the GPS L1 waveband and the insertion loss within a range of the frequency bands of 2.4 GHz of WiFi and 5 GHz of WiFi is higher, so the antenna system 2 may effectively isolate radio frequency signals of the antenna system 1 on the basis of the second matching network.

The second matching network may also adopt a more complex filter network, for example, any one of a frequency selector with a shunt inductor, a frequency selector with a series capacitor, a frequency selector with a shunt capacitor, a frequency selector with a series inductor or a wave trap for the antenna system 2. In an embodiment, in a terminal, the antenna system 2 may be arranged to transmit radio frequency signals at the lowest frequency band and the antenna system 1 may be arranged to transmit radio frequency signals at the other high frequency bands. For example, the antenna system 2 covers the frequency band corresponding to the GPS L1 waveband and the antenna system 1 covers medium and high common frequency bands (1.71 GHz-2.69 GHz) of a cellular mobile communication network.

Figure 6:
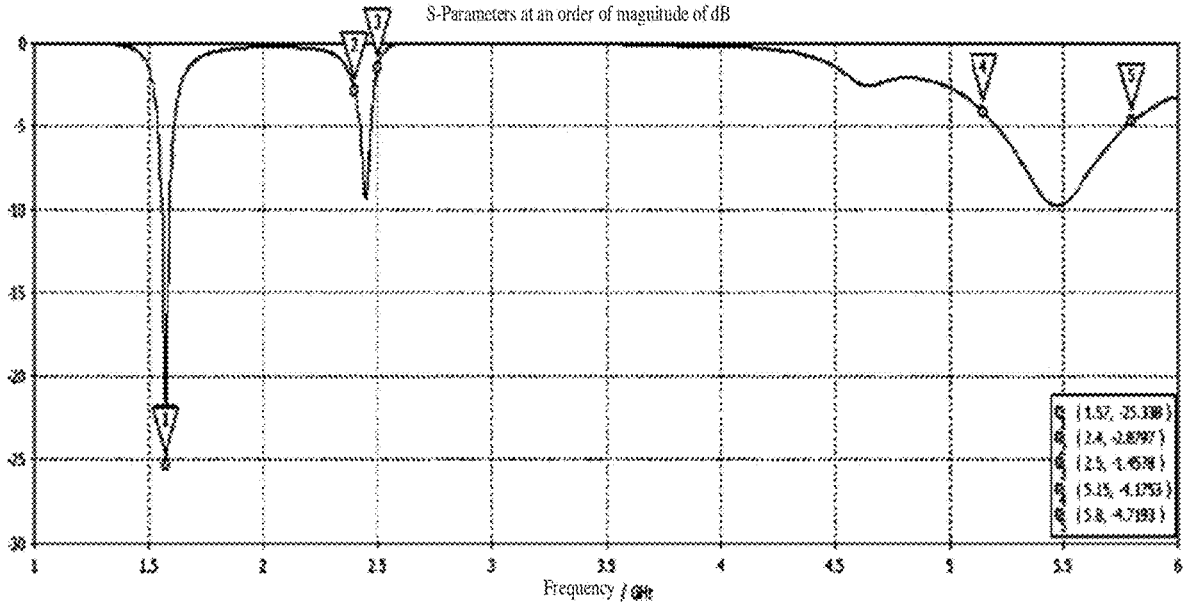
FIG. 6 is a return loss performance curve chart of an antenna system according to some embodiments.
Figure 7:
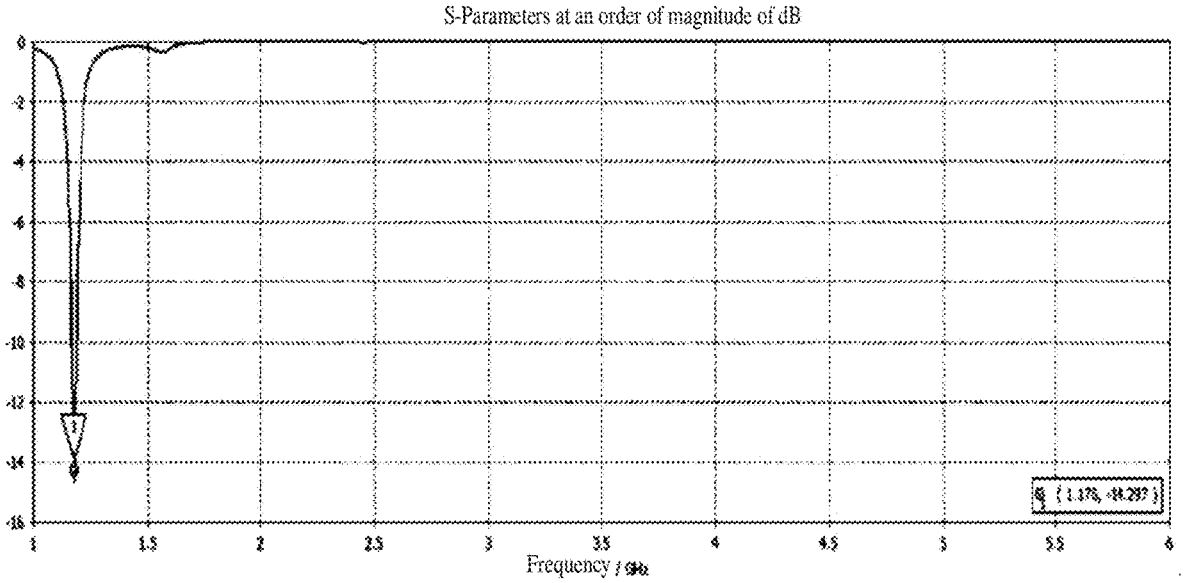
FIG. 7 is a return loss performance curve chart of an antenna system according to some embodiments.
Figure 8:
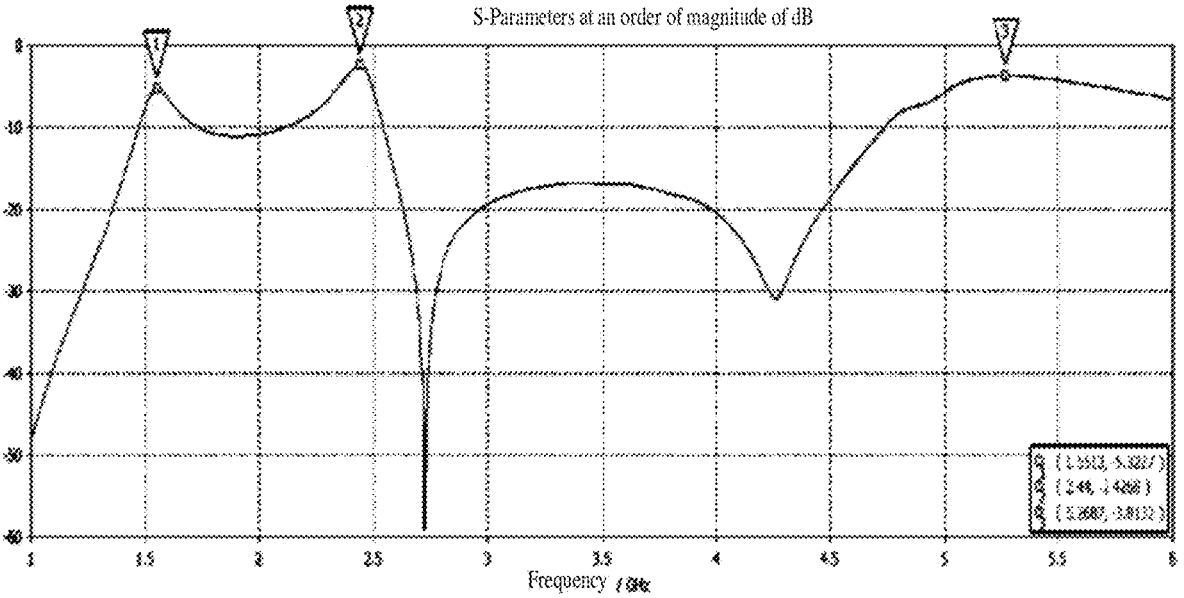
FIG. 8 is a frequency-dependent curve chart of isolation between an antenna system 1 and an antenna system 2 which are not matched through a first matching network and a second matching network, respectively, according to some embodiments.
Figure 9:
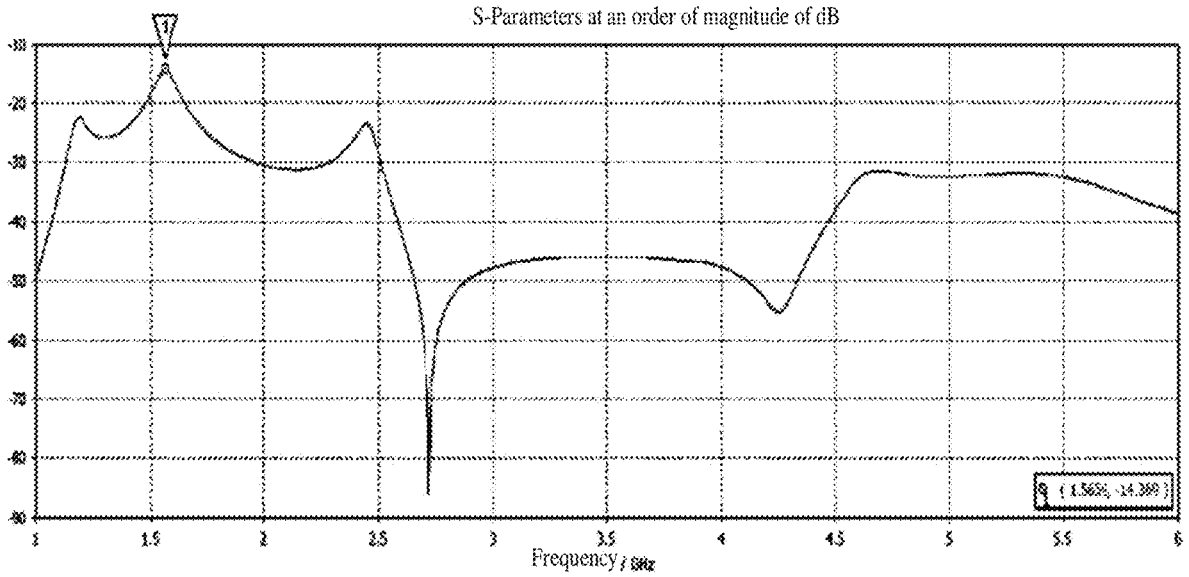
FIG. 9 is a frequency-dependent curve chart of isolation between an antenna system 1 and an antenna system 2 which are matched through a first matching network and a second matching network, respectively, according to some embodiments.

The antenna system 1 and the antenna system 2 may achieve antenna system return loss performance shown in FIG. 6 and FIG. 7 respectively. FIG. 8 is a frequency-dependent curve chart of isolation between the antenna system 1 and the antenna system 2 which are not matched through the first matching network and the second matching network, respectively. From FIG. 8, it can be seen that isolation performance between the two antenna systems is relatively poor and the lowest frequency point isolation is only −2.44 dB. FIG. 9 is a frequency-dependent curve chart of isolation between the antenna system 1 and the antenna system 2 which are matched through the first matching network and the second matching network, respectively. From FIG. 9, it can be seen that the isolation performance between the two matched antenna systems can reach −14.34 dB which is greatly improved by 11.9 dB.

Figure 10:
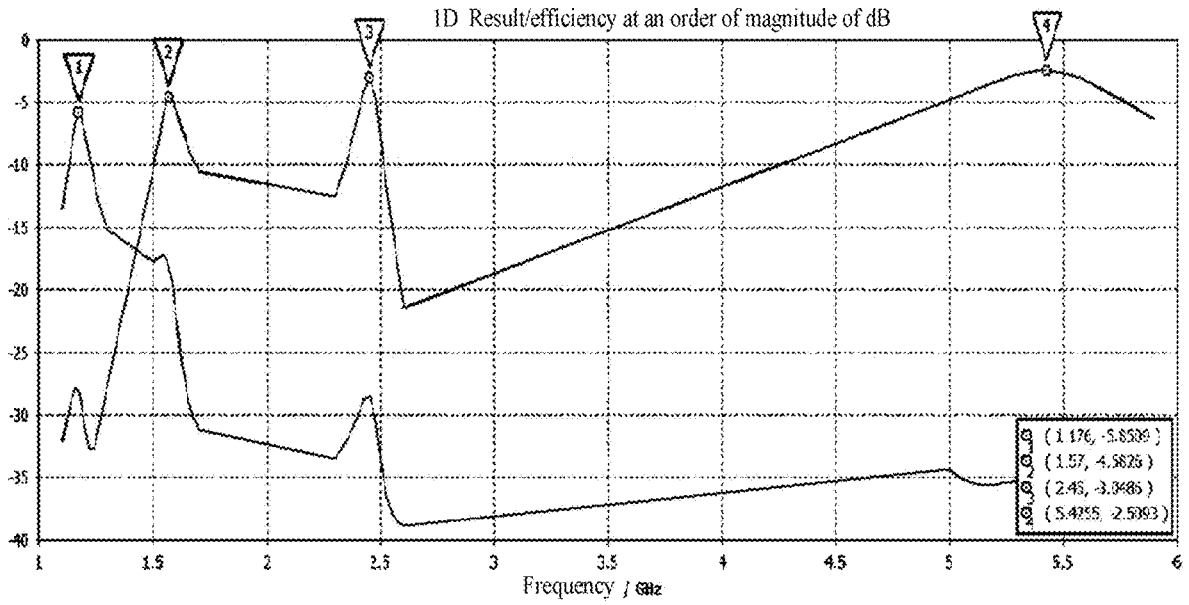
FIG. 10 is an efficiency curve chart of an antenna system according to some embodiments.

FIG. 10 is an efficiency curve chart of an antenna system according to some embodiments. As shown in FIG. 10, the efficiency of the antenna system in each frequency band may meet a routine antenna standard of an existing mobile terminal. Practical tests show that the antenna system may effectively improve the positioning accuracy and, particularly in a non-open environment full of urban roads with bridges and buildings, accuracy of positioning and movement trajectory acquisition is improved. The antenna system 2 in the antenna system of the embodiment of the present disclosure is relatively small and relatively high efficiency for the GPS L5 waveband and has less influence on antennas at the other three frequency bands, and since the second matching network and the second radio frequency path are used independently, loss of the radio frequency path is lower; and on the other hand, the antennas at the other three frequency bands may be debugged more independently and flexibly and the problem that debugging a certain frequency band of a four-band antenna will affect the frequency offsets of the other three frequency bands may be solved.

The present disclosure also provides a terminal, which includes any above described antenna system. The terminal is, for example, a smart mobile terminal or another smart device with positioning and WiFi functions.

Figure 11:
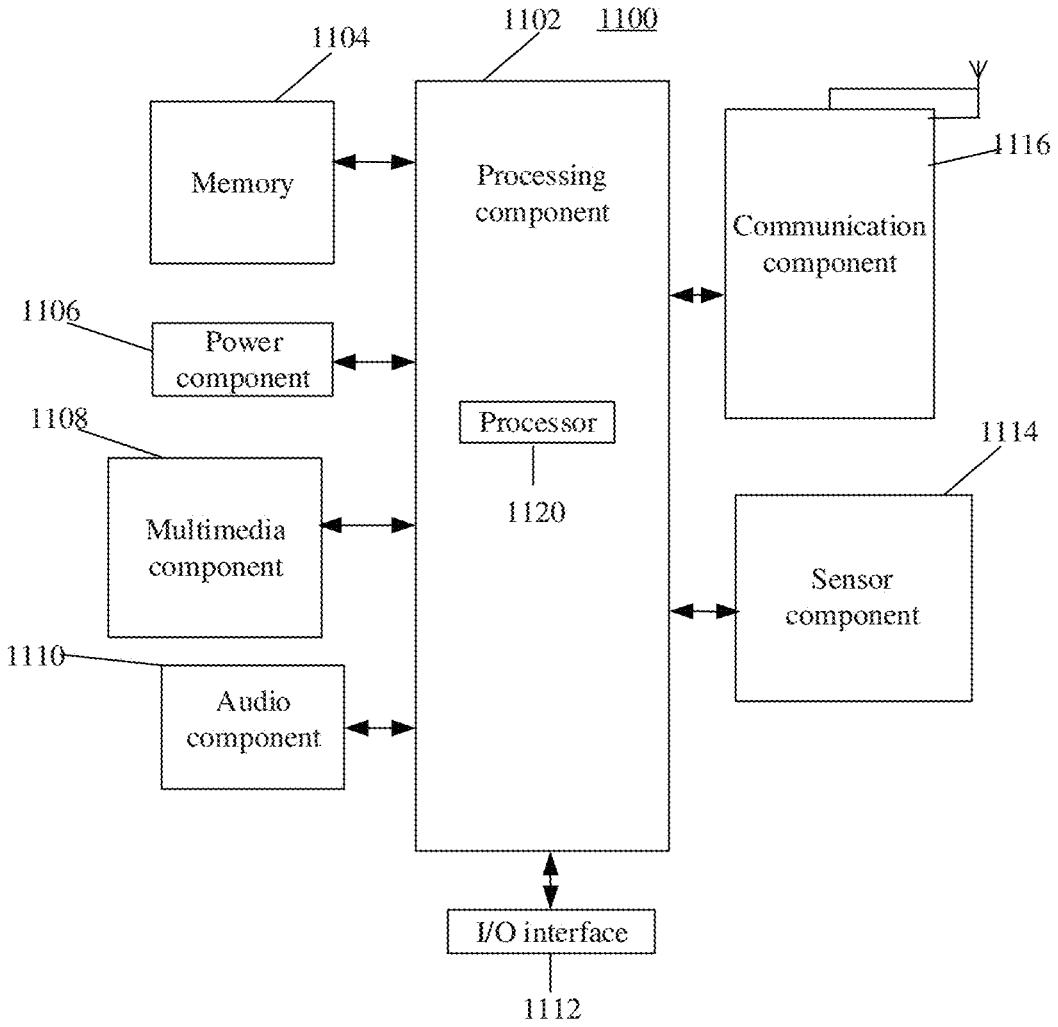
FIG. 11 is a block diagram of a terminal according to some embodiments.

FIG. 11 is a block diagram of a terminal 1100 according to some embodiments. For example, the terminal 1100 may be a mobile phone, a computer, a digital broadcast terminal, a messaging device, a gaming console, a tablet, a medical device, exercise equipment, a personal digital assistant and the like.

Referring to FIG. 11, the terminal 1100 may include one or more of the following components: a processing component 1102, a memory 1104, a power component 1106, a multimedia component 1108, an audio component 1110, an Input/Output (I/O) interface 1112, a sensor component 1114, and a communication component 1116.

The processing component 1102 typically controls overall operations of the terminal 1100, such as the operations associated with display, telephone calls, data communications, camera operations, and recording operations. The processing component 1102 may include one or more processors 1120 to execute instructions to perform all or part of the operations in the abovementioned method. Moreover, the processing component 1102 may include one or more modules which facilitate interaction between the processing component 1102 and the other components. For instance, the processing component 1102 may include a multimedia module to facilitate interaction between the multimedia component 1108 and the processing component 1102.

The memory 1104 is configured to store various types of data to support the operations of the terminal 1100. Examples of such data include instructions for any application programs or methods operated on the terminal 1100, contact data, phonebook data, messages, pictures, video, etc. The memory 1104 may be implemented by any type of transitory or non-transitory memory devices, or a combination thereof, such as a Static Random Access Memory (SRAM), an Electrically Erasable Programmable Read-Only Memory (EEPROM), an Erasable Programmable Read-Only Memory (EPROM), a Programmable Read-Only Memory (PROM), a Read-Only Memory (ROM), a magnetic memory, a flash memory, and a magnetic or optical disk.

The power component 1106 provides power for various components of the terminal 1100. The power component

1106 may include a power management system, one or more power supplies, and other components associated with generation, management and distribution of power for the terminal 1100.

The multimedia component 1108 includes a screen providing an output interface between the terminal 1100 and a user. In some embodiments, the screen may include a Liquid Crystal Display (LCD) and a Touch Panel (TP). If the screen includes the TP, the screen may be implemented as a touch screen to receive an input signal from the user. The TP includes one or more touch sensors to sense touches, swipes and gestures on the TP. The touch sensors may not only sense a boundary of a touch or swipe action but also detect a duration and pressure associated with the touch or swipe action. In some embodiments, the multimedia component 1108 includes a front camera and/or a rear camera. The front camera and/or the rear camera may receive external multimedia data when the terminal 1100 is in an operation mode, such as a photographing mode or a video mode. Each of the front camera and the rear camera may be a fixed optical lens system or have focusing and optical zooming capabilities.

The audio component 1110 is configured to output and/or input an audio signal. For example, the audio component 1110 includes a microphone (MIC), and the MIC is configured to receive an external audio signal when the terminal 1100 is in the operation mode, such as a call mode, a recording mode and a voice recognition mode. The received audio signal may further be stored in the memory 1104 or sent through the communication component 1116. In some embodiments, the audio component 1110 further includes a speaker configured to output the audio signal.

The I/O interface 1112 provides an interface between the processing component 1102 and a peripheral interface module, and the peripheral interface module may be a keyboard, a click wheel, a button and the like. The button may include, but not limited to: a home button, a volume button, a starting button and a locking button.

The sensor component 1114 includes one or more sensors configured to provide status assessment in various aspects for the terminal 1100. For instance, the sensor component 1114 may detect an on/off status of the terminal 1100 and relative positioning of components, such as a display and small keyboard of the terminal 1100, and the sensor component 1114 may further detect a change in a position of the terminal 1100 or a component of the terminal 1100, presence or absence of contact between the user and the terminal 1100, orientation or acceleration/deceleration of the terminal 1100 and a change in temperature of the terminal 1100. The sensor component 1114 may include a proximity sensor configured to detect presence of an object nearby without any physical contact. The sensor component 1114 may also include a light sensor, such as a Complementary Metal Oxide Semiconductor (CMOS) or Charge Coupled Device (CCD) image sensor, configured for use in an imaging application. In some embodiments, the sensor component 1114 may also include an acceleration sensor, a gyroscope sensor, a magnetic sensor, a pressure sensor or a temperature sensor.

The communication component 1116 is configured to facilitate wired or wireless communication between the terminal 1100 and other equipment. The terminal 1100 may access a communication-standard-based wireless network, such as a WiFi network, a 2nd-Generation (2G) or 3rd-Generation (3G) network or a combination thereof. In some embodiments, the communication component 1116 receives a broadcast signal or broadcast associated information from an external broadcast management system through a broadcast channel. In some embodiments, the communication component 1116 further includes a Near Field Communication (NFC) module to facilitate short-range communication. For example, the NFC module may be implemented on the basis of a Radio Frequency Identification (RFID) technology, an Infrared Data Association (IrDA) technology, an Ultra-WideBand (UWB) technology, a Bluetooth (BT) technology and another technology.

In some embodiments, the terminal 1100 may be implemented by one or more Application Specific Integrated Circuits (ASICs), Digital Signal Processors (DSPs), Digital Signal Processing Devices (DSPDs), Programmable Logic Devices (PLDs), Field Programmable Gate Arrays (FPGAs), controllers, micro-controllers, microprocessors or other electronic components, and is configured to execute the abovementioned method.

Other implementations of the present disclosure will be apparent to those skilled in the art from consideration of the specification and practice of the present disclosure. The present disclosure is intended to cover any variations, uses, or adaptations of the present disclosure following the general principles thereof and including such departures from the present disclosure as come within known or customary practice in the art. It is intended that the embodiments be considered as exemplary only, with a true scope and spirit of the present disclosure being indicated by the following claims.

It will be appreciated that the present disclosure is not limited to the exact embodiments that have been described above and illustrated in the accompanying drawings, and that various modifications and changes may be made without departing from the scope thereof. It is intended that the scope of the present disclosure only be limited by the appended claims.

According to the antenna system of the embodiments of the present disclosure, the first metal radiator and the second metal radiator are connected with the first radio frequency path and the second radio frequency path respectively through a respective matching network to form two antenna systems, and radio frequency signals of the two antenna systems may be effectively mutually isolated, so that influence therebetween is avoided and radiation efficiency of the antenna system is improved.

What is claimed is:

1. An antenna system, comprising:

a first metal radiator, a second metal radiator, a first matching network, a second matching network, a first radio frequency path, and a second radio frequency path, wherein:

a tail end of the first metal radiator is connected with a first feed point of the antenna system and the first feed point is connected with the first radio frequency path through the first matching network; and a tail end of the second metal radiator is connected with a second feed point of the antenna system and the second feed point is connected with the second radio frequency path through the second matching network, wherein the first metal radiator is a first metal frame of a terminal, the second metal radiator is a second metal frame of the terminal, a tail end of the first metal frame is adjacent to a tail end of the second metal frame, and a gap is formed between the tail end of the first metal frame and the tail end of the second metal frame, and wherein the first metal frame comprises a transverse extension part and a longitudinal extension part, a total length of the transverse extension part and the longitudinal extension part is 10 mm to 30 mm, and a length of the second metal frame is smaller than 30 mm, wherein the first metal radiator is arranged to have a resonance frequency at a frequency band corresponding to a Global Positioning System (GPS) L1 waveband, a resonance frequency at a 2.4 GHz frequency band of Wireless Fidelity (WiFi), and a resonance frequency at a 5 GHz frequency band of the WiFi, and the second metal radiator is arranged to have a resonance frequency at a frequency band corresponding to a GPS L5 waveband;

wherein the second matching network comprises a capacitor and an inductor, wherein a first end of the capacitor of the second matching network is connected with the second feed point and a first end of the inductor of the second matching network, and a second end of the capacitor of the second matching network is grounded, and a second end of the inductor of the second matching network is connected with the second radio frequency path.

2. The antenna system of claim 1, wherein a width of the gap is 0.5 mm to 3 mm.

3. The antenna system of claim 1, wherein the first matching network comprises:

a first capacitor, a second capacitor, a first inductor, and a second inductor, wherein:

a first end of the first capacitor is connected with the first feed point, and a second end of the first capacitor is connected with a first end of the second capacitor and a first end of the first inductor; and a second end of the first inductor is connected with a second end of the second capacitor, a first end of the second inductor and the first radio frequency path, and a second end of the second inductor is grounded.

4. The antenna system of claim 1, wherein a resonance frequency of the first metal radiator is greater than a resonance frequency of the second metal radiator.

5. A terminal, comprising an antenna system, wherein the antenna system comprises:

a first metal radiator, a second metal radiator, a first matching network, a second matching network, a first radio frequency path, and a second radio frequency path, wherein:

a tail end of the first metal radiator is connected with a first feed point of the antenna system and the first feed point is connected with the first radio frequency path through the first matching network; and a tail end of the second metal radiator is connected with a second feed point of the antenna system and the second feed point is connected with the second radio frequency path through the second matching network, wherein the first metal radiator is a first metal frame of the terminal, the second metal radiator is a second metal frame of the terminal, a tail end of the first metal frame is adjacent to the tail end of the second metal frame, and a gap is formed between the tail end of the first metal frame and the tail end of the second metal frame, and wherein the first metal frame comprises a transverse extension part and a longitudinal extension part, a total length of the transverse extension part and the longitudinal extension part is 10 mm to 30 mm, and a length of the second metal frame is smaller than 30 mm, wherein the first metal radiator is arranged to have a resonance frequency at a frequency band corresponding to a Global Positioning System (GPS) L1 waveband, a resonance frequency at a 2.4 GHz frequency band of Wireless Fidelity (WiFi), and a resonance frequency at a 5 GHz frequency band of the WiFi, and the second metal radiator is arranged to have a resonance frequency at a frequency band corresponding to a GPS L5 waveband;

wherein the second matching network comprises a capacitor and an inductor, wherein:

a first end of the capacitor of the second matching network is connected with the second feed point and a first end of the inductor of the second matching network, and a second end of the capacitor of the second matching network is grounded; and a second end of the inductor of the second matching network is connected with the second radio frequency path.

6. The terminal of claim 5, wherein a width of the gap is 0.5 mm to 3 mm.

7. The terminal of claim 5, wherein the first matching network comprises:

a first capacitor, a second capacitor, a first inductor, and a second inductor, wherein:

a first end of the first capacitor is connected with the first feed point, and a second end of the first capacitor is connected with a first end of the second capacitor and a first end of the first inductor; and a second end of the first inductor is connected with a second end of the second capacitor, a first end of the second inductor and the first radio frequency path, and a second end of the second inductor is grounded.

8. The terminal of claim 5, wherein a resonance frequency of the first metal radiator is greater than a resonance frequency of the second metal radiator.

* * * * *